US007404267B2

(12) United States Patent
Evans et al.

(10) Patent No.: US 7,404,267 B2
(45) Date of Patent: Jul. 29, 2008

(54) PORTABLE SNAP-FIT SIGN STAND

(75) Inventors: Evan C Evans, Commerce Township, MI (US); Brian J Hillstrom, Milford, MI (US)

(73) Assignee: Marketing Displays, Inc., Farmington Hills, MI (US)

( * ) Notice: Subject to any disclaimer, the term of this patent is extended or adjusted under 35 U.S.C. 154(b) by 159 days.

(21) Appl. No.: 11/522,553

(22) Filed: Sep. 14, 2006

(65) Prior Publication Data

US 2007/0006499 A1 Jan. 11, 2007

Related U.S. Application Data

(62) Division of application No. 10/960,419, filed on Oct. 7, 2004, now Pat. No. 7,107,714.

(60) Provisional application No. 60/519,075, filed on Nov. 10, 2003.

(51) Int. Cl.
*G09F 15/00* (2006.01)

(52) U.S. Cl. ..... 40/610; 40/606.01; 40/607.04

(58) Field of Classification Search ..... 40/610, 40/606.01, 607.04; 116/63 P; 285/305, 399, 285/319; 248/127; 403/399
See application file for complete search history.

(56) References Cited

U.S. PATENT DOCUMENTS

| | | | | |
|---|---|---|---|---|
| 1,505,046 | A | | 8/1924 | Lush |
| 1,598,438 | A | | 8/1926 | Hallowell |
| 1,887,894 | A | | 11/1932 | Schwab |
| 1,918,933 | A | | 7/1933 | Rogers |
| 2,454,648 | A | | 11/1948 | Green |
| 2,863,238 | A | | 12/1958 | Keech |
| 3,347,575 | A | * | 10/1967 | Morris ..... 403/107 |
| 3,646,696 | A | | 3/1972 | Sarkisian |
| 3,662,482 | A | * | 5/1972 | Sarkisian ..... 40/602 |
| 4,593,879 | A | * | 6/1986 | Seely et al. ..... 248/624 |
| RE32,359 | E | | 2/1987 | Seely |
| 4,691,892 | A | * | 9/1987 | Grewe et al. ..... 248/624 |
| 5,340,068 | A | * | 8/1994 | Sarkisian et al. ..... 248/188.6 |
| 5,429,417 | A | | 7/1995 | Kim |
| 5,437,425 | A | * | 8/1995 | Hou ..... 248/188.6 |
| 5,442,871 | A | | 8/1995 | Sarkisian et al. |
| 5,964,052 | A | * | 10/1999 | Jepsen et al. ..... 40/607.1 |

* cited by examiner

*Primary Examiner*—Gary C Hoge
(74) *Attorney, Agent, or Firm*—Harness, Dickey & Pierce, P.L.C.

(57) ABSTRACT

A display device having a support structure and display panel is provided. The support structure generally includes a cross bar horizontally supported by first and second leg assemblies. A coupling is provided at each end of the cross bar to receive the corresponding leg assemblies. A plurality of locking mechanisms are provided for independently and releasably connecting the cross bar and the leg assemblies to the coupling without requiring the use of tools.

7 Claims, 6 Drawing Sheets

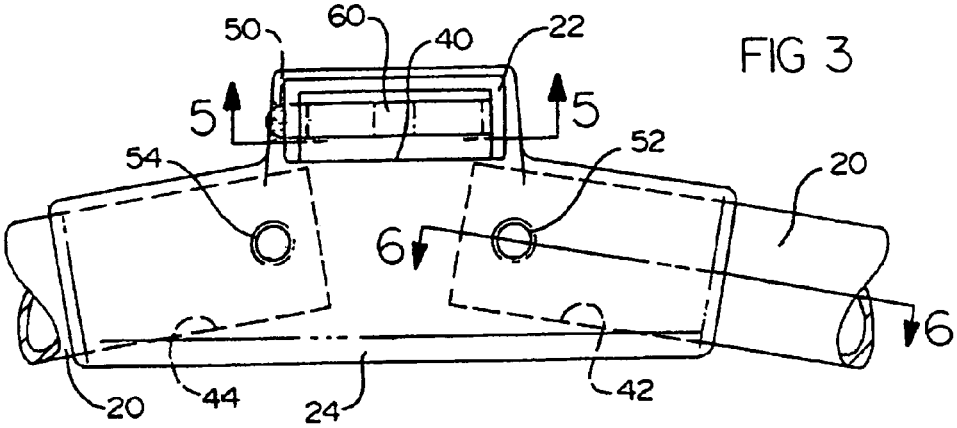
FIG 3
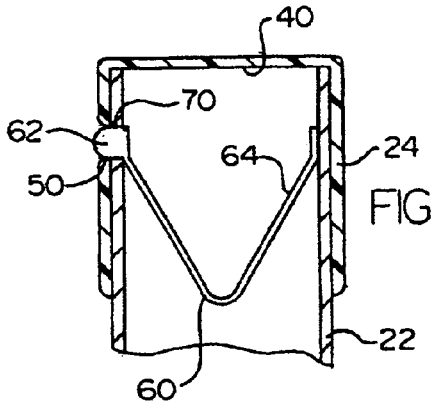
FIG 5
FIG 4
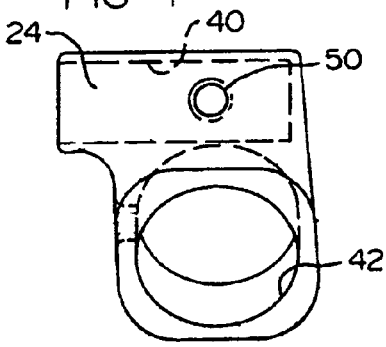
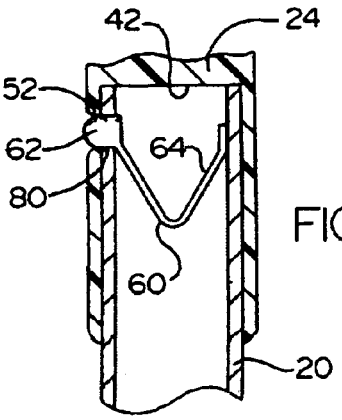
FIG 6

PORTABLE SNAP-FIT SIGN STAND

CROSS-REFERENCE TO RELATED APPLICATIONS

This application is a divisional of U.S. patent application Ser. No. 10/960,419 filed on Oct. 7, 2004 which claims the benefit of U.S. Provisional Application No. 60/519,075, filed on Nov. 10, 2003.

FIELD OF THE INVENTION

The present invention relates to portable display signs and, more particularly, to a portable snap-fit sign stand which may be assembled without requiring tools.

BACKGROUND OF THE INVENTION

Portable display devices have become widespread in the advertising industry. They are often used out of doors and, therefore, must be freestanding. Conventional freestanding display devices include a support structure and a frame for containing a display card. The support structure often includes a cross bar and a set of legs affixed thereto. The cross bar supports the frame in a vertical manner. The legs are fixed to the cross bar with threaded fasteners. A problem with the conventional configuration is that tools are required for assembly. Therefore, assembly can be difficult and overly time consuming. Furthermore, storage of these devices is hindered because they take up a lot of space in an assembled condition.

SUMMARY OF THE INVENTION

The present invention is directed to a sign stand assembly that may be readily assembled and disassembled without requiring tools. In a preferred embodiment, a portable snap-fit sign is provided including a display card maintained on a support structure. The support structure includes a cross bar supported horizontally between two pair of leg members. Each end of the cross bar and each of the legs are independently and releasably connected to a corresponding coupling with a locking mechanism. The display card is supported on the cross bar with a pair of spring members which allow the sign to deflect in relation to the support structure when subjected to wind gusts.

In an alternate embodiment, a portable snap-fit sign is provided including a display card maintained on a support structure. The support structure includes a cross bar supported horizontally between two pair of leg members. Each leg is independently and releasably connected to a corresponding coupling with a locking mechanism. Furthermore, each leg is engaged with the horizontal cross bar to add further rigidity to the support structure. The display card is supported on the cross bar with a pair of spring members which allow the sign to deflect in relation to the support structure when subjected to wind gusts.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 3 is a detail view of the coupling, legs and cross bar shown in FIG. 1;

FIG. 4 is an end view of the coupling shown in FIG. 3;

FIG. 5 is a cross-sectional view taken along V-V of FIG. 3;

FIG. 6 is a cross-sectional view taken along the line VI-VI of FIG. 3;

DETAILED DESCRIPTION OF THE PREFERRED EMBODIMENTS

The following description of the preferred embodiments is merely exemplary in nature and is in no way intended to limit the invention, its application, or uses.

Figure 1:
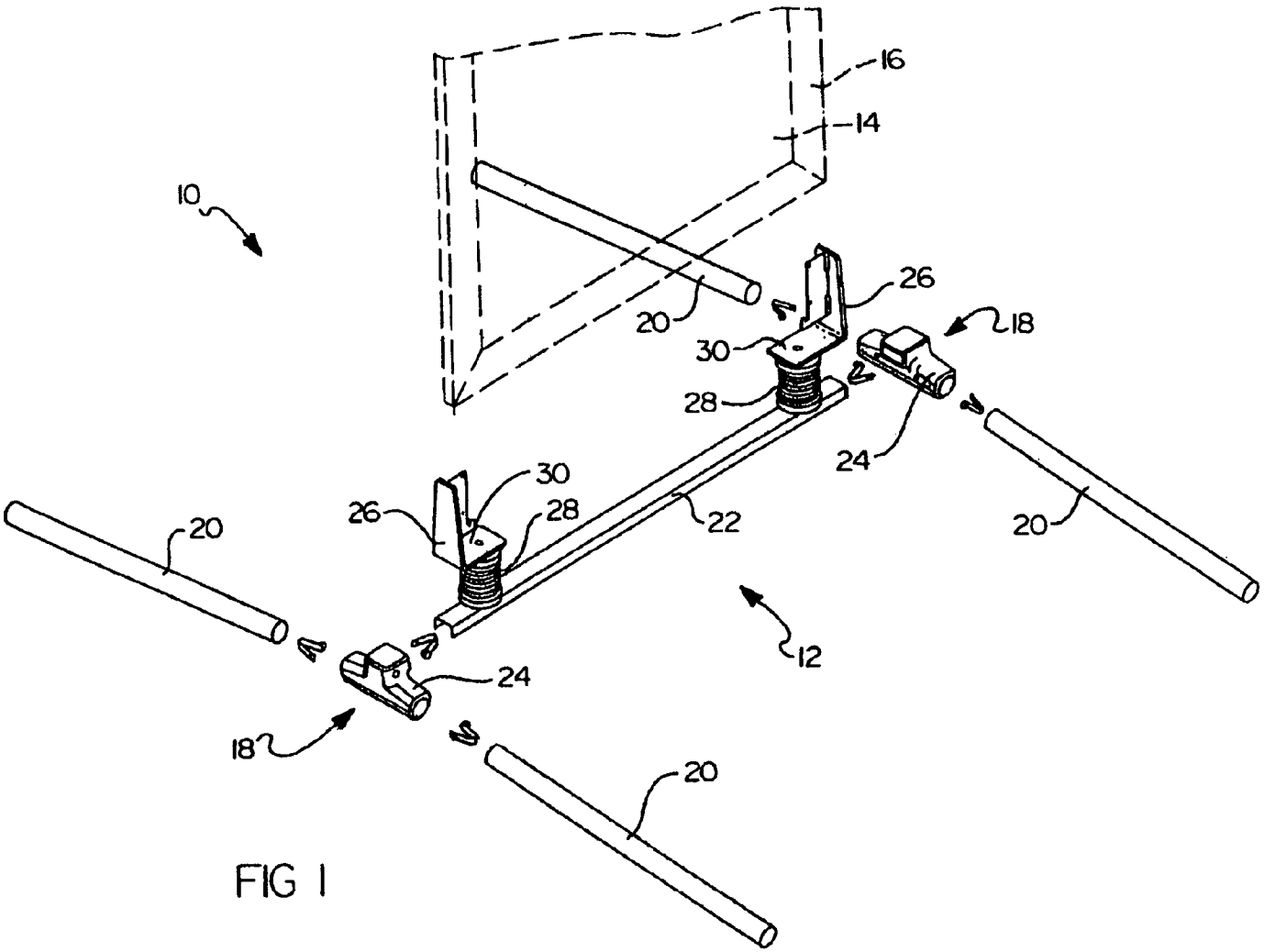
FIG. 1 is an exploded perspective view of a display device in accordance with the present invention.
Figure 2:
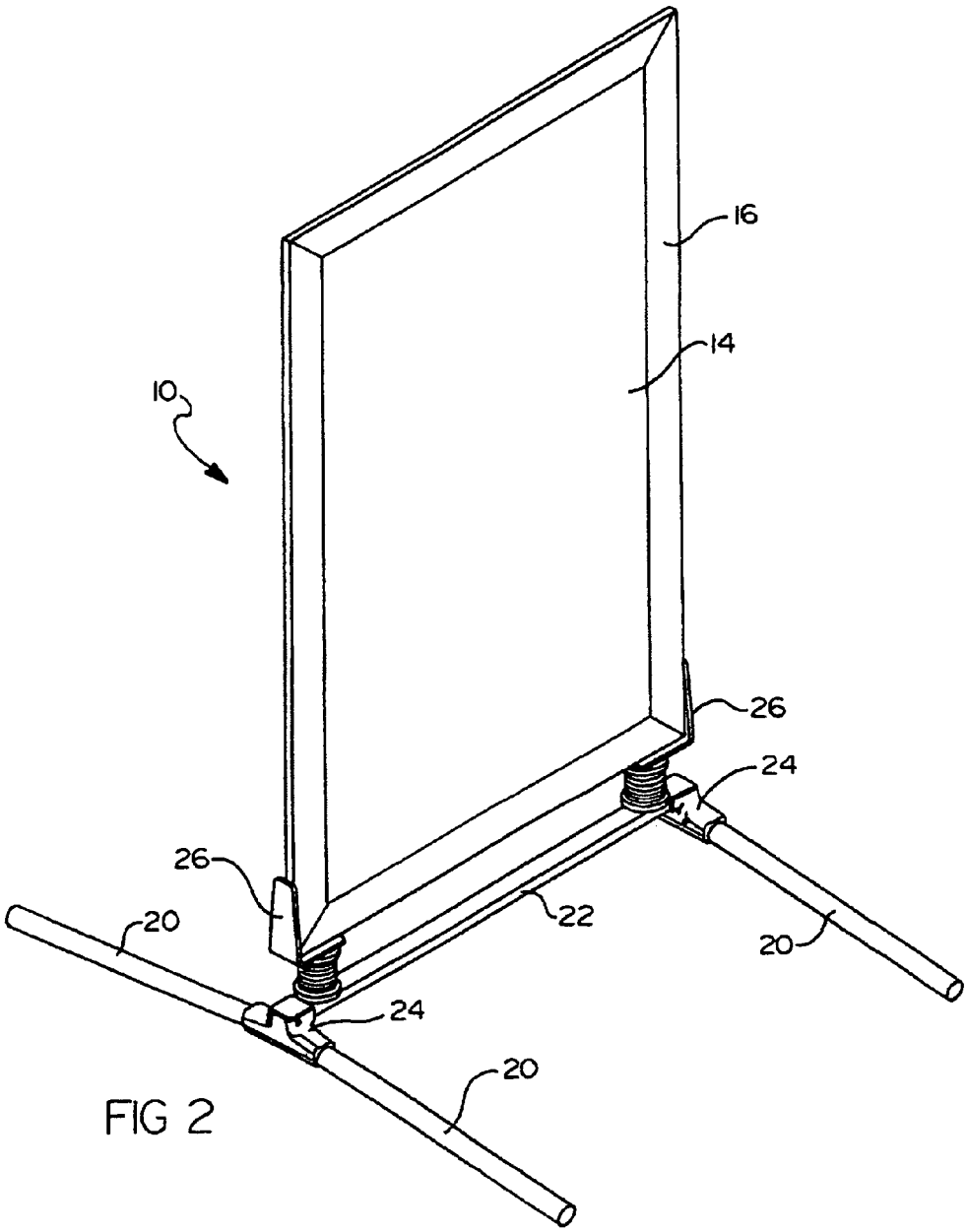
FIG. 2 is a perspective view of a display device in accordance with the present invention.

With reference to FIGS. 1 and 2, a preferred embodiment of the display device 10 is provided including a support structure 12 and a display card 14 in a frame 16. The support structure 12 generally includes two pair of leg assemblies 18. Each leg assembly 18 generally includes a pair of tubular leg members 20 releasably connected to a coupling 24 supporting a cross bar 22 horizontally. The cross bar 22 is also releasably connected to the coupling 24 and supports two frame brackets 26, each including a spring member 28 and an L-shaped member 30. The frame brackets 26 are adapted to cradle the frame 16, which contains a display card 14. A manufacturer uses fasteners (not shown) to secure the frame 16 to each L-shaped member 30, thereby maintaining the frame 16 in a vertical position. In an exemplary embodiment, the spring members 28 of the frame brackets 26 enable the frame 16 and display card 14 to respond to forces of wind independently of the support structure 12.

With reference to FIGS. 3 and 4, a preferred embodiment of the interconnect at coupling 24 in accordance with the present invention is provided. The coupling 24 generally includes a transverse cavity 40 for receiving an end of the cross bar 22. An aperture 50 penetrates the coupling 24 and extends into transverse cavity 40. The coupling 24 further includes a pair of opposed axial cavities 42, 44 for receiving leg members 20. More specifically, axial cavities 42, 44 are disposed at a slight downward angle of approximately 10° off horizontal. In this manner, the leg members 20 support the cross bar 22 above the ground on which it stands. The coupling 24 also includes a plurality of apertures. Apertures 52, 54 penetrate the coupling 24 and extend into the axial cavities 42, 44 respectively. It should be appreciated that while only one coupling 24 is described, identical couplings are incorporated on both sides of the support structure 12. Furthermore, each coupling should be adapted to be selectively connected to the cross bar 22 and a pair of leg members 20. As presently preferred, the coupling 24 is an injection molded polycarbonate part. However, other materials and methods of fabrication may provide a suitable coupling.

FIG. 5 illustrates an exemplary embodiment of a cross bar 22 secured to a coupling 24 by a locking mechanism 60. The cross bar 22 includes a channeled member with an aperture 70 through its side wall. The aperture 70 is in alignment with the aperture 50 extending into transverse cavity 40 in the coupling 24. The locking mechanism 60 includes a quick release mechanism having a detent button 62 biased by a spring element 64. The detent button 62, in the locked position, extends through the cross bar aperture 70 and into aperture 50 of the coupling 24 to releasably and independently secure the cross bar 22 in the transverse cavity 40 of the coupling 24. A force may be applied to the detent button 62 to disconnect the cross bar 22 from the coupling 24. The force displaces the detent button 62 into the transverse cavity 40 to disengage the coupling 24, thereby enabling the cross bar 22 to be removed therefrom.

FIG. 6 illustrates an exemplary embodiment of a leg member 20 secured to a coupling 24 by a locking mechanism 60. The leg member 20 has an aperture therethrough 80. The aperture 80 is aligned with the second aperture 52 in the coupling 24. The locking mechanism 60 includes a quick release mechanism having a detent button 62 biased by a spring element 64. The detent button 62 extends through the aperture 80 in the leg member 20 and the aperture 52 in the coupling 24 to releasably and independently secure the leg member 20 in the axial cavity 42. A force is applied to the detent button 62 to disconnect the leg member 20 from the coupling 24. The force displaces the detent button 62 into the axial cavity 42 to disengage the coupling 24, thereby enabling the leg member 20 to be removed therefrom. It should be appreciated that another leg member 20 is secured in the other axial cavity 44 (including extension of the first aperture 54) of the coupling 24 in the same manner as that just described. It will also be appreciated that each leg member 20 and each end of the cross bar 22 include an independent locking mechanism 60 for being secured to the couplings 24. It should further be appreciated that while a detent button quick release mechanism is described as an exemplary embodiment, alternative quick release mechanisms are intended to be within the scope of the present invention.

Prior to assembly, the leg members 20 and the cross bar 22 are entirely disassembled from the couplings 24. However, each of these components include a locking mechanism 60 disposed therein, as described above, which may be employed to releasably secure the legs 20 and the cross bar 22 to the coupling 24. Each locking mechanism 60 includes a quick release mechanism, such as the detent button 62 and spring element 64 mechanism described above. A force is applied to the detent button 62 to connect each component within a respective cavity in the coupling 24. The force displaces the detent button 62 into the tubular or channeled component. This decreases a dimension of the component and enables insertion into a cavity 40, 42, 44. Once the component has been inserted, the detent button 62 is aligned with a corresponding aperture in the coupling 24. Once aligned, the spring element 64 forces the detent button 62 into engagement with the aperture. This secures the component in place. The same steps are completed for each leg member 20 and each end of the cross bar 22 to assemble the display device 10 of the present invention. Thus, the support structure 12 may be readily assembled and disassembled without the use of tools.

Figure 7:
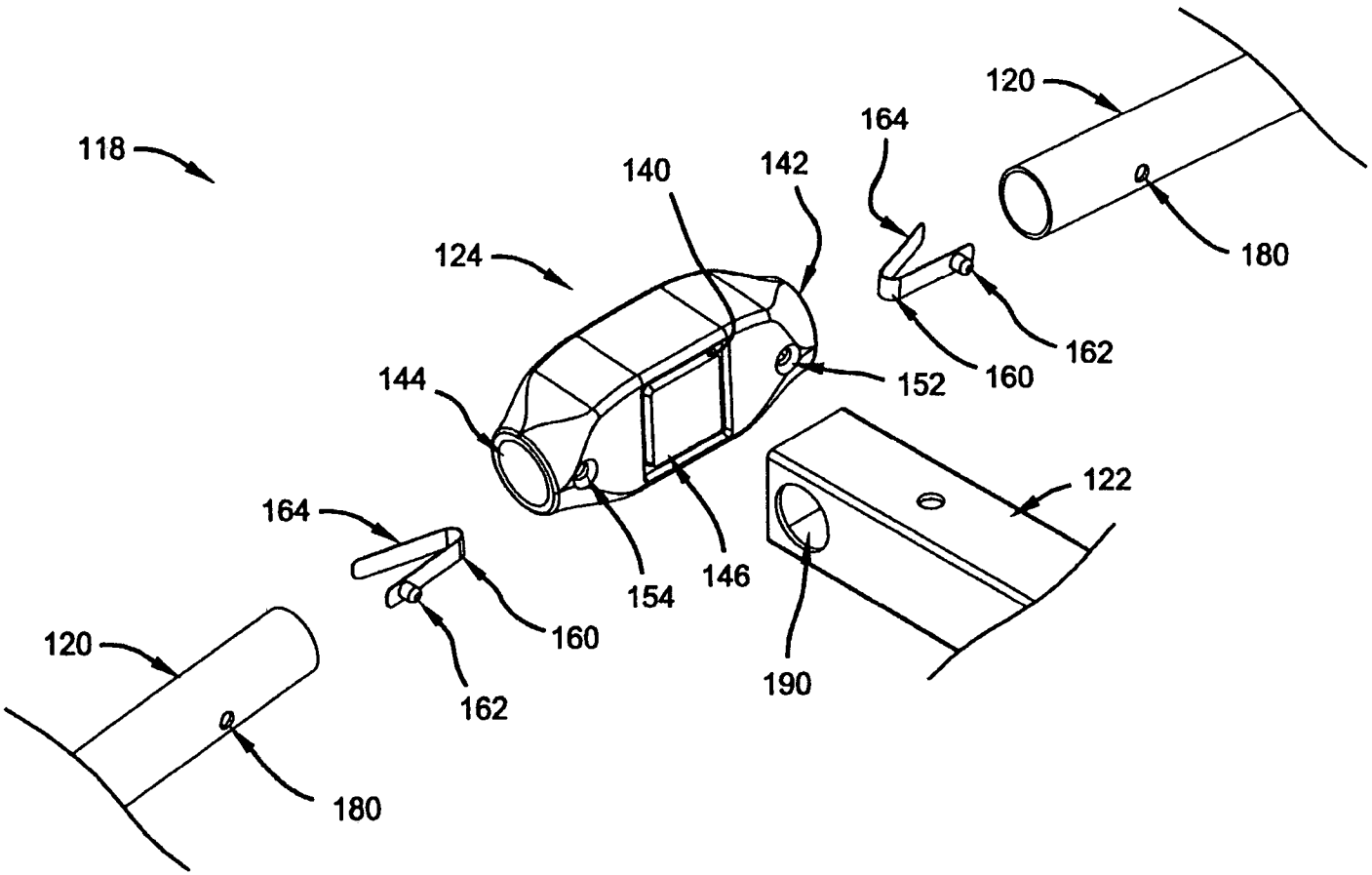
FIG. 7 is an exploded perspective view of an alternate embodiment of the coupling, legs and cross bar in accordance with the present invention.
Figure 8:
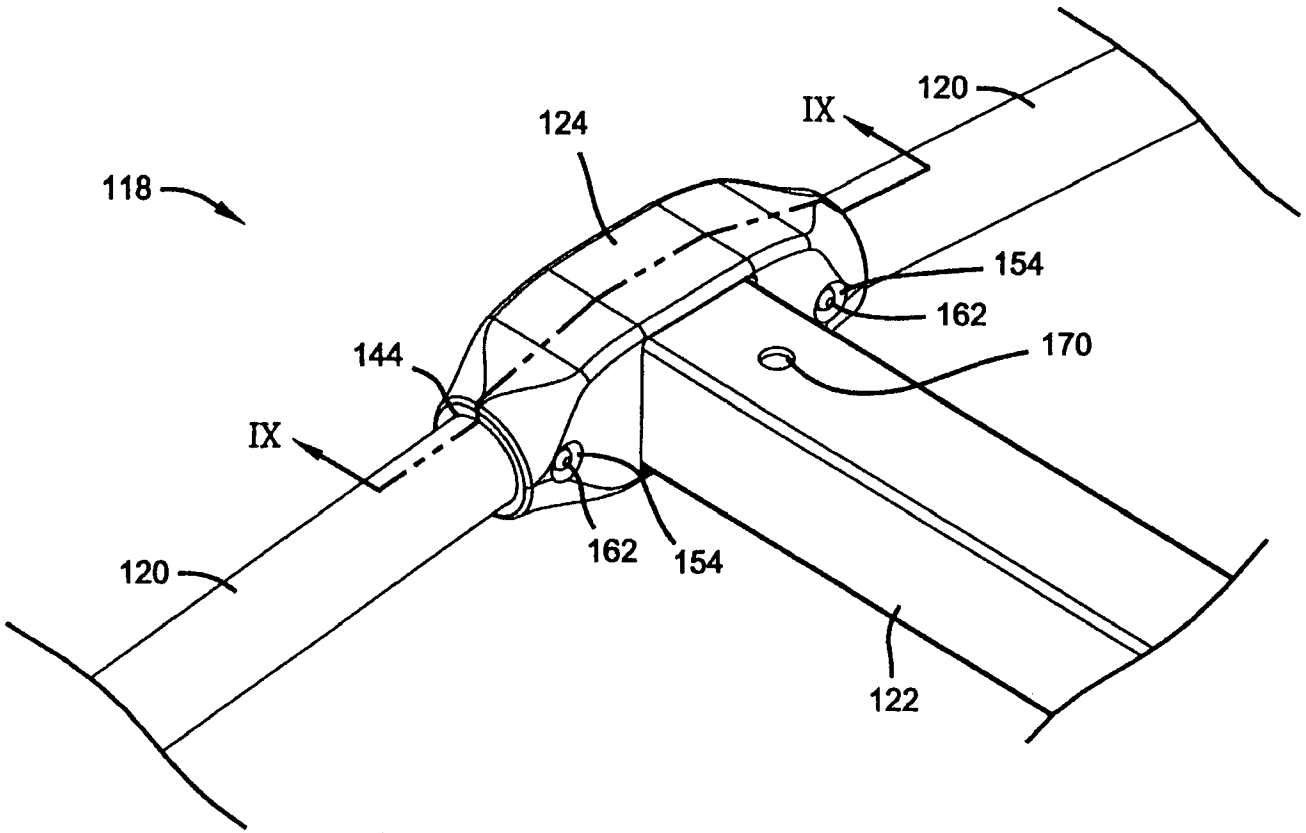
FIG. 8 is a perspective view of the alternate embodiment shown in FIG. 7 in an assembled state.
Figure 9:
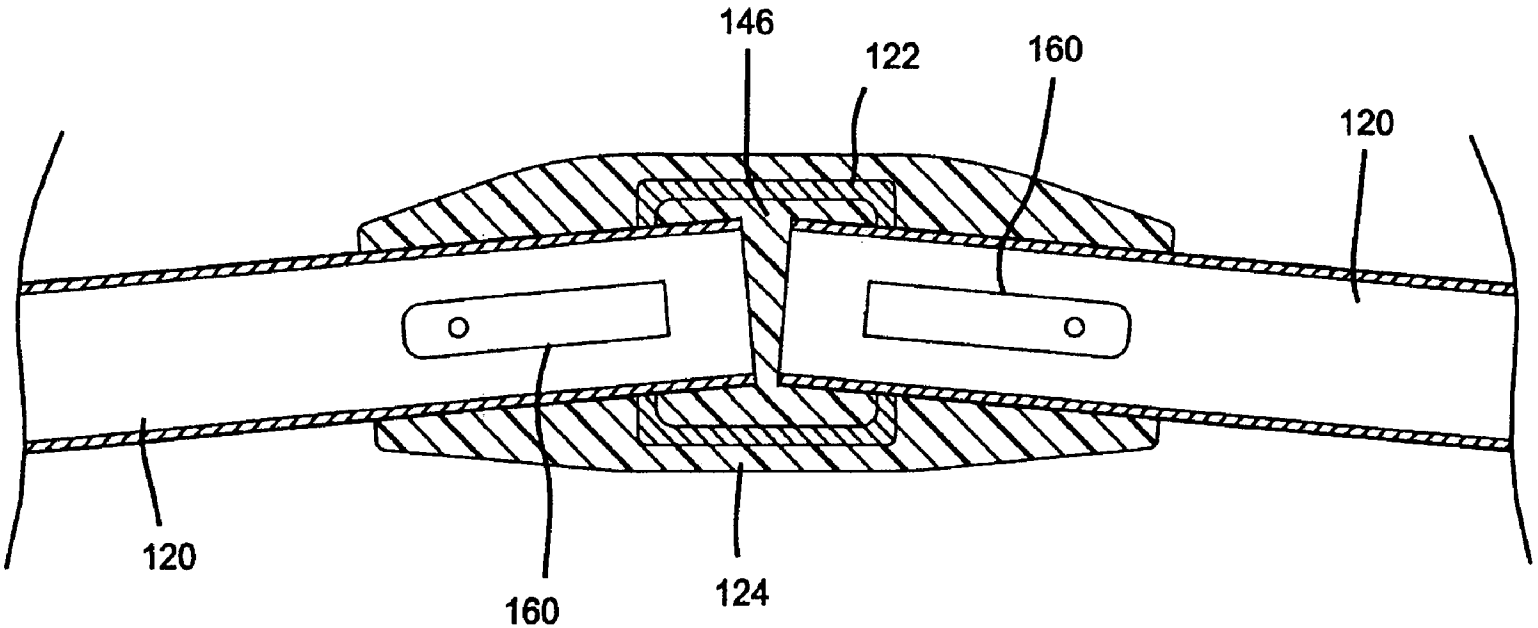
FIG. 9 is a cross-sectional view taken along IX-IX of FIG. 8.

With reference to FIGS. 7-9, and in accordance with the present invention, an alternate embodiment of a leg assembly 118 for use in support structure 12 is illustrated. Leg assembly 18 includes a pair of leg members 120 and a cross bar 122 interconnected by coupling 124. The coupling 124 generally includes a transverse cavity 140 for receiving an end of a cross bar 122. The coupling 124 further includes a pair of opposed axial cavities 142, 144 for receiving leg members 120. More specifically, axial cavities 142, 144 are disposed at a slight downward angle of approximately 10° off horizontal. Furthermore, the cross bar 122 includes a set of apertures 190 (a total of four, two on each end, only one of which can be seen in FIG. 7) for receiving leg members 120. Apertures 190 are in alignment with axial cavities 142, 144, when cross bar 122 is inserted into transverse cavity 140. Leg members 120 are received in apertures 190 when inserted into axial cavities 142, 144 of coupling 124. In this manner, leg members 120 interlock with cross bar 122 and cooperate to create a more rigid base for legs 120. The coupling 124 also includes other apertures. Apertures 152, 154 extend through a side wall of the coupling 124 and into the axial cavities 142, 144 respectively. It should be appreciated that while only one coupling 124 is described, identical couplings are incorporated on both sides of the cross bar 122 to selectively connect to the cross bar 122 and a pair of leg members 120. As presently preferred, the coupling 124 is an injection molded polycarbonate part. However, other materials and methods of fabrication may provide a suitable coupling.

Leg member 120 is secured to a coupling 124 by a locking mechanism 160. The leg member 120 has an aperture 180 therethrough. The aperture 180 is aligned with the aperture 152 in the coupling 124. The locking mechanism 160 includes a quick release mechanism having a detent button 162 biased by a spring element 164. The detent button 162 extends through the aperture 180 in the leg member 120 and through the aperture 152 in the coupling 124 to releasably and independently secure the leg member 120 in axial cavity 142 and aperture 190. A force is applied to the detent button 162 to disconnect the leg member 120 from the coupling 124. The force displaces the detent button 162 into the axial cavity 142 to disengage the coupling 124, thereby enabling the leg member 120 to be removed therefrom. It should be appreciated that another leg member 120 is secured in the other axial cavity 144 (including extension of the first aperture 154) of the coupling 124 and the other pair of apertures 190 of the cross bar 122 in the same manner as that just described. It will also be appreciated that each leg member 120 includes an independent locking mechanism for securing to the coupling 124, while the cross bar 122 interlocks with the leg members 120 for securement to the coupling 124. It should further be appreciated that quick release mechanism described above is as an exemplary embodiment, and alternative locking mechanisms are suitable and intended to be within the scope of the present invention.

FIG. 9 further illustrates how each leg member 120 interlocks with the cross bar 122 within the coupling 124. The engagement between each leg member 120, the axial cavities 142, 144 and pairs of apertures 190 of the cross bar 122 provides for a more rigid base. Furthermore, support block 146 is formed in transverse cavity 140 of coupling 124. Support block 146 is shaped to be complimentary with the inner wall of the cross bar 122. Axial cavities 142, 144 extend into support block 146 to receive the ends of legs 120.

Prior to assembly, the leg members 120 and the cross bar 122 are entirely disassembled from the couplings 124 as seen in FIG. 7. Initially, cross bar 122 is inserted into transverse cavity 140. The inner wall of the cross bar 122 is supported by the support block 146 of coupling 124 formed in cavity 140. Thus, the end of the cross bar 122 is captured within the coupling 124 to provide a snug fit with little to no play. Next, each leg member 120 is inserted into its respective axial cavity 142, 144. Specifically, a force is applied to the detent button 162 to connect each leg member 120 within a respective cavity in the coupling 124. The dimension of the component is decreased and enables insertion of the leg member 120 into cavity 142, 144. Once the leg member 120 has been inserted, the detent button 162 is aligned with a corresponding aperture 152, 154 in the coupling 124, and the spring element 164 forces the detent button 162 into engagement with the aperture 152, 154. This secures the leg member 120 in place. Furthermore, leg members 120, when secured to coupling 124 are also received through apertures 190 of the cross bar 122 and interlock with cross bar 122. The interaction between each leg member 120, axial cavities 142, 144 of the coupling 124, and the pairs of apertures 190 of the cross bar 122 creates a rigid locking mechanism that holds each leg member 120 and the cross bar 122 in place. The same steps are completed for each leg member 120 and each end of the cross bar 122 to assemble the display device 10 of the present invention. Thus, the support structure 12 may be readily assembled and disassembled without the use of tools.

The present invention has been described with reference to its preferred embodiments. However, one skilled in the art will recognize that certain modifications may be made without departing from the present invention. For example, the size and shape of the coupling 24, 124 may be modified for a given application. Likewise, the location and orientation of the detent apertures 50, 52, 54, 152, 154 in the coupling 24, 124 may be modified. Furthermore, the preferred embodiment illustrates a support structure in which all of the leg members 20, 120 and the cross bar 22, 122 are releasably secured to the coupling. One skilled in the art will understand that the support structure may employ fewer or more locking mechanisms. For example, each of the leg assemblies 18, 118 may reflect a unitary element which is releasably secured to the cross bar 22, 122. Similarly, the preferred embodiment illustrates a locking mechanism disposed within the cross bar 22 or leg members 20, 120. However, the present invention could include a locking mechanism 60 or detent feature which is disposed within the cavities 40, 42, 44, 142, 144 formed in the coupling, and, thus, contemplated by the present invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A support structure for a display device comprising:

a cross bar having a sign bracket located between a first end and a second end;

a first leg assembly having a first transverse cavity receiving said first end of said cross bar;

a first locking mechanism disposed in said cross bar at said first end, said first locking mechanism including a first detent biased to an extended position wherein at least a portion of said first detent extends from said cross bar and engages said first leg assembly to attach said cross bar thereto and positionable to a retracted position wherein said first detent is within said cross bar and disengages said first leg assembly to detach said cross bar therefrom;

a second leg assembly having a second transverse cavity receiving said second end of said cross bar; and a second locking mechanism disposed in said cross bar at said second end, said second locking mechanism including a second detent biased to an extended position wherein at least a portion of said second detent extends from said cross bar and engages said second leg assembly to attach said cross bar thereto and positionable to a retracted position wherein said detent is within said cross bar and disengages said second leg assembly to detach said cross bar therefrom.

2. The support structure of claim 1 further comprising a first pair of legs interlocking with said first leg assembly and a second pair of legs interlocking with said second leg assembly.

3. The support structure of claim 2 wherein each of said first pair of legs extends through a respective aperture formed in said first leg assembly, and each of said second pair of legs extends through a respective aperture formed in said second leg assembly.

4. The support structure of claim 1 further comprising a pair of sign panel brackets coupled to said cross bar.

5. The support structure of claim 4 wherein each of said pair of sign panel brackets are coupled to said cross bar by a spring member.

6. A display device having the support structure of claim 1 and further comprising a display card supported from said sign bracket in a generally vertical orientation.

7. A method of assembling or disassembling the support structure of claim 1 without the use of tools comprising:

manually positioning said first detent to said retracted position;

moving said cross bar relative to said first leg assembly;

manually positioning said second detent to said retracted position; and moving said cross bar relative to said second leg assembly.

* * * * *